US009170594B2

(12) United States Patent
Bhattad et al.

(10) Patent No.: US 9,170,594 B2
(45) Date of Patent: Oct. 27, 2015

(54) CC-CV METHOD TO CONTROL THE STARTUP CURRENT FOR LDO

(71) Applicant: Dialog Semiconductor GmbH, Kirchheim/Teck-Nabern (DE)

(72) Inventors: Ambreesh Bhattad, Swindon (GB); Frank Kronmueller, Neudenau (DE); Alper Ucar, Reading (GB); Hande Kurnaz, Dettingen unter Teck (DE)

(73) Assignee: Dialog Semiconductor GmbH, Kirchheim/Feck-Nabern (DE)

( * ) Notice: Subject to any disclaimer, the term of this patent is extended or adjusted under 35 U.S.C. 154(b) by 174 days.

(21) Appl. No.: 14/147,685

(22) Filed: Jan. 6, 2014

(65) Prior Publication Data

US 2015/0177757 A1 Jun. 25, 2015

(30) Foreign Application Priority Data

Dec. 20, 2013 (EP) ..... 13368045

(51) Int. Cl.
*G05F 1/575* (2006.01)
*G05F 1/573* (2006.01)

(52) U.S. Cl.
CPC ..... *G05F 1/575* (2013.01); *G05F 1/573* (2013.01)

(58) Field of Classification Search
CPC ..... G05F 1/56; G05F 1/567; G05F 1/573; G05F 1/575
USPC ..... 323/275–280
See application file for complete search history.

(56) References Cited

U.S. PATENT DOCUMENTS 5,666,044 A * 9/1997 Tuozzolo ..... G05F 1/573 323/273
7,548,051 B1 * 6/2009 Tenbroek et al. ..... G05F 1/56 323/273
8,194,379 B2 6/2012 Herr et al.
(Continued)

FOREIGN PATENT DOCUMENTS

DE 10061738 6/2002

OTHER PUBLICATIONS

Co-pending US Patent DS12-038, U.S. Appl. No. 13/852,149, filed Mar. 28, 2013, "Method to Limit the Inrush Current in Large Output LDO's," by Pier Cavellini et al., 30 pgs.
(Continued)

*Primary Examiner* — Adolf Berhane
*Assistant Examiner* — Yemane Mehari
(74) *Attorney, Agent, or Firm* — Saile Ackerman LLC; Stephen B. Ackerman

(57) ABSTRACT

Methods and circuits for linearly controlling a limited, constant current during startup of LDOs, amplifiers, or DC-to-DC converters independent of load capacitor size and controlling a clean transition without glitches from a constant current (CC) mode during startup to a constant voltage (CV) mode during normal operation (CC-CV method) are disclosed. The constant current control loop and the constant voltage control loop are implemented in such a way that at the end of startup the voltage loop has taken over control and the current loop is moved far away from its active transistor region, allowing a switch of modes to occur without any nasty transitions on the output.

34 Claims, 7 Drawing Sheets

(56) References Cited

U.S. PATENT DOCUMENTS

| | | | | |
|---|---|---|---|---|
| 2006/0113978 | A1 | 6/2006 | Suzuki | |
| 2007/0216383 | A1 | 9/2007 | Al-Shyoukh et al. | |
| 2012/0205978 | A1* | 8/2012 | Wong | G05F 1/56 307/31 |
| 2012/0262137 | A1 | 10/2012 | Arigliano et al. | |
| 2013/0249513 | A1 | 9/2013 | Kujala et al. | |
| 2013/0320942 | A1 | 12/2013 | Vemula | |

OTHER PUBLICATIONS

Co-pending US Patent DS12-060, U.S. Appl. No. 14/020,979, filed Sep. 9, 2013, "Method and Apparatus for Limiting Startup Inrush Current for Low Dropout Regulator," by Ambreesh Bhattad et al., 38 pgs.

European Search Report 13368045.4-1807, Mailed: Jun. 6, 2014, Dialog Semiconductor GmbH.

* cited by examiner

CC-CV METHOD TO CONTROL THE STARTUP CURRENT FOR LDO

TECHNICAL FIELD

The present document relates to electronic circuits. In particular, the present document relates to linearly controlling a constant startup current (CC-mode) and slope during startup phase and a glitch-free transition to constant voltage (CV) mode during normal operation of low drop-out (LDO) converters, amplifiers, DC-DC converters and the like.

BACKGROUND

In prior art, the current limit of the LDO/Amplfier or the like was reduced at startup in order to reduce the startup current. It was restored to normal current limit once the output voltage reached within 90% of its regulated voltage. If the output capacitor was relatively large this would result in a sudden increase in the inrush current when the normal current limit was restored. This could result in an overshoot at the output. The inrush current would vary a lot with process, temperature and supply.

The slope of the startup current was not controlled. A very sharp edge of inrush current would act as shock wave for decoupling capacitor and interfere with audio signal on a handheld.

In case a handheld device is getting charged with a current limited supply (as e.g. an USB with 100 mA current) a large inrush current at startup may discharge the decoupling capacitors on the supply and result in a system shutdown.

In case an output smoothing capacitor is relative large this would result in a sudden increase of the inrush current when the normal current limit is restored. This could result in an overshoot at the output.

The slope of the startup current is not controlled in prior art. A very sharp edge of inrush current would act like a shock wave for a decoupling capacitor and would interfere e.g. with audio signals on a handheld device In case a handheld device is getting charged with a current limited supply, e.g. an USB with 100 mA current limit, a large inrush current at startup may discharge the decoupling capacitors on the supply and result in a system shutdown.

The scenario showed in FIG. 11 prior art illustrates a non-limiting example of a possible application of the present disclosure.

The system of FIG. 11 prior art shows a mains charger powering a power management integrated circuit (PMIC) and charging a battery. The switch shown can be used to charge the battery when a charger is attached or can be used in absence of charger to power the PMIC from battery. The PMIC may comprise for example several low drop-out (LDO) regulators and some buck DC-to DC converters.

In case the charger circuit is both charging the battery and powering the PMIC. The maximum allowable current from the charger may be I1.

Under no condition should the sum of currents I2+I3 get higher than current I1, if that happens the charger circuit will be overloaded and the output voltage from the charger will fall causing the PMIC to reboot.

When an LDO or a buck converter is enabled the output decoupling capacitors (not shown) will have to be charged. The maximum current during startup would be limited by a current limit of the buck converter or the LDO. If this current limit is higher than the difference I1−I3, which may be well possible, the system may shutdown and goes into a loop of starting and shutting down.

The startup current for the sub-blocks of PMIC has to be regulated in order to avoid a situation like this. The current at startup must also be independent of supply, process and temperature.

Charger systems have an output impedance, bandwidth and maximum current capability. As the charger system is external to PMIC these parameters may vary a lot. When any of the sub-blocks in the PMIC is enabled during charging process the current at startup would come from supply decoupling capacitors at the input of PMIC (not shown). This would require large decoupling capacitors which would occupy large area on the printed circuit board (PCB) which is very expensive for a handheld device.

The amount of decoupling capacitors would be reduced if the startup current could be well regulated and the time taken to reach the maximum regulated current at startup be controlled.

It is a challenge for designers of low drop-out (LDO) converters, amplifiers, DC-DC converters, or the like to achieve a controlled linear method of limiting a constant current during startup independent of the size of a load capacitor with reduced dependence on process, supply and temperature to avoid any harmonics created in the audio band during startup, and achieve a clean startup when getting charged with a current limited supply.

SUMMARY

A principal object of the present disclosure is to achieve a controlled linear method of limiting a constant startup current during startup of electronic devices independent of the size of a load capacitor.

A further object of the present disclosure is to achieve a controlled linear method of limiting the current during startup of LDOs, amplifiers, or DC-to-DC converters independent of the size of a load capacitor.

A further object of the disclosure is to avoid any harmonics created in the audio band during startup.

A further object of the disclosure is to achieve a method of linearly controlling the startup current for LDO or Amplifiers with reduced dependence on process, supply and temperature variation.

A further object of the disclosure is to achieve a clean startup when getting charged with a current limited supply.

A further object of the disclosure is to get the electronic device not affected by startup in case of getting charged with a current limited supply.

A further object of the disclosure is to achieve a combination of a startup and overcurrent preventing circuits in the same circuitry saving area and complexity.

In accordance with the objects of this disclosure a method for linearly controlling a limited, constant current during startup of a circuit of an electronic apparatus until an output voltage is close a target voltage of normal operation is reached independent of load capacitor size and a clean transition without glitches from a constant current (CC) mode during startup to a constant voltage (CV) mode during normal operation (CC-CV method) has been achieved. The method disclosed comprises the steps of: (1) providing a circuit of an electronic apparatus comprising a load capacitor, a current sensing means, a current control loop, comprising a current control transistor to set and control the start-up current and to control a current limit during normal operation in order to keep the output current below a maximum limit, and a voltage control loop to control the output voltage during normal operation, wherein the voltage control loop comprises a voltage control transistor, (2) sensing and controlling linearly the startup current by the current control loop to get a constant, limited start-up current of the circuit during start-up phase until an output voltage of the circuit is close to a target value, wherein the current control transistor wherein the current control transistor operates in saturation mode during the startup phase, and (3) starting, when the output voltage of the circuit is close to the target value, to shift from constant startup current control mode to constant output voltage mode controlled by a voltage control loop and to shift to current limit control of normal operation by the current control loop by gradually shifting the current control transistor from saturation mode to linear mode and finally to triode mode achieving a seamless transition from constant current mode to constant voltage mode to occur without any glitches on the smoothing load capacitor.

In accordance with the objects of this disclosure a circuit capable of linearly controlling a limited, constant startup current during a startup phase of an electronic apparatus having a load capacitor, until an output voltage close to a target value of the output voltage of normal operation is reached, wherein a clean transition from a constant current (CC) mode during the startup phase to a constant voltage (CV) mode during normal operation independent of a size of the load capacitor without glitches is ensured, has been achieved. The circuit disclosed comprises a pass transistor, capable of providing a constant output current to during the startup phase and an output current during normal operation, wherein the pass transistor is connected between a supply voltage, an output port, and an arrangement in parallel of an output capacitor and a resistive voltage divider, which is deployed between the output port and ground, wherein a middle point of the voltage divider is capable of providing a feedback voltage representing the output voltage, a current control loop comprising a current control transistor capable of controlling a constant, limited start-up current of the circuit during a start-up phase until an output voltage of the circuit has reached a value close to a target value and to keep the output current below a limit after the startup phase during normal operation of the circuit, and a voltage control loop capable of controlling the output voltage of the circuit, wherein the control loop is configured to gradually starting to control the output voltage when the output voltage has reached a value close to the target value and is in full control when the output voltage is reached, wherein the voltage control loop is capable of gradually shifting the current control transistor from saturation mode to linear mode and finally to triode mode during the transition from constant current mode to constant voltage mode in order to achieve a seamless transition without glitches.

BRIEF DESCRIPTION OF THE FIGURES

The invention is explained below in an exemplary manner with reference to the accompanying drawings, wherein

FIG. 11 prior art depicts an example of a scenario the disclosure may be applied to.

DETAILED DESCRIPTION

Methods and circuits are disclosed for linearly controlling a limited, constant current during startup of LDOs, voltage amplifiers, DC-to-DC converters or of any other electronic apparatus having a load capacitor, wherein the startup is independent of load capacitor size and is controlling a clean transition without glitches from a constant current (CC) mode during startup to a constant voltage (CV) mode during normal operation (CC-CV method). The regulated current during startup phase has a reduced dependence on variations of process, supply, and temperature. Cleaning up the startup process significantly reduces those factors.

Figure 12:
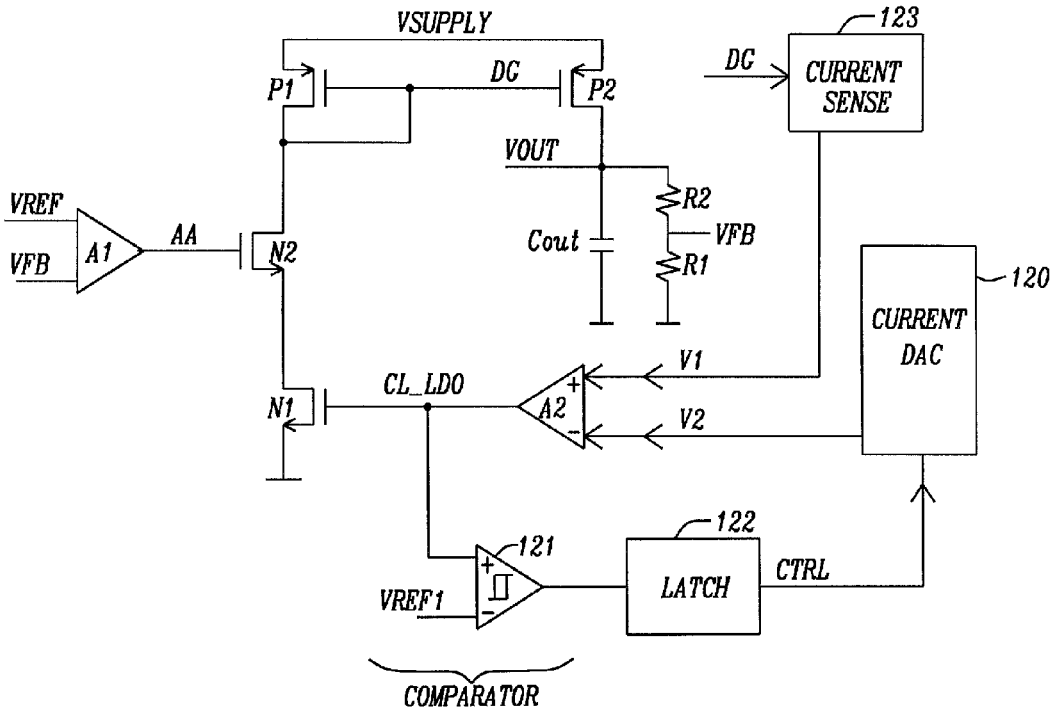
FIG. 12 shows a simplified block diagram of the circuit disclosed.

FIG. 12 shows a simplified block diagram of the circuit disclosed illustrating an exemplary implementation of the (CC-CV) method disclosed at an LDO for controlling the inrush current during startup for a low drop-out (LDO) regulator and to ensure a clean transition from CC mode to CV mode.

It has to be noted that the method disclosed is applicable not only to LDO's but also to any other electronic apparatus having a load capacitor such as voltage amplifiers.

The circuit of FIG. 12 comprises resistors R1 and R2 forming a resistor voltage divider network for providing a feedback voltage VFB representing an actual output voltage of the LDO and a decoupling capacitor Cout at the output of LDO.

Current control transistor N1, voltage control transistor N2, P1 and error amplifier A1 form a driving circuit for the pass transistor P2. A current sense circuit 123, a current digital-to-analog converter (DAC) 120, providing an output voltage via a means of resistance, along with N1 and amplifier A2 form the current limit loop in normal operation and the same circuit is used to regulate the startup current.

The differential amplifier A2, comparator 121 and the latch 122 determine the transition from constant current mode during startup to regulated controlled constant voltage mode during normal operation.

Constant Current (CC) Mode During Startup:

At the beginning of startup the output voltage VOUT is at ground potential. The feedback node VFB is also at ground potential. The output voltage AA of the error amplifier A1 is pulled to supply which completely switches transistor voltage control transistor N2 ON . . . .

The difference between the voltage V1, generated at the output of the current sense circuit 123, and voltage V2, which is generated at the output of current DAC 120 as a voltage drop via a resistive means as e.g. a resistor, causes the potential of the node CL_LDO at the gate of N1 to rise. An output current of current DAC 120 provides the voltage V2 via a resistor (not shown). It should be noted that the voltage V2 shown in FIG. 12 corresponds to the voltage VR shown in FIG. 1.

The increase of potential at node CL_LDO gradually turns ON transistor N1. As N1 switches ON, current starts to flow in the branch N1, N2 and P1.

Transistors P1 and P2 form a current mirror pair which results in a current flowing out of P2 to charge the capacitor Cout. The currents through P1 and P2 keep increasing till potential at V1 equals V2. Once V1 equals V2 there is no further increase in the current charging capacitor Cout. And the output capacitor is charged with a constant regulated current because the voltage of node CL_LDO has reached its operating point.

Transition to Regulated Voltage Mode:

A key point of the disclosure is a smooth transition from constant current mode during the startup phase to a regulated constant voltage mode. An increase of the output voltage Vout relates to increase in the potential of feedback voltage VFB. As the voltage difference between VRef and VFB reduces the voltage at node AA gets smaller. Reduction of the voltage at the gate of transistor N2 relates to reduction in voltage across transistor N1 because the voltage at gate defines the voltage at source.

As the node VFB comes close to Vref the potential at node AA comes closer to its operating point which is close to threshold voltage of N2. Reduction in potential at node AA causes the transistor N1 to move from saturation to linear region of operation. This causes the current to decrease through N1 and subsequently the current flowing through of P2 to charge Cout decrease accordingly. A decrease of the output current again increases the voltage difference between V1 and V2. The output of amplifier A2, i.e. CL_LDO, starts to increase reducing the difference, till it gets saturated and is clamped to VSUPPLY potential. Increase of the potential at CL_LDO and decrease in potential at AA pushes N1 deep into triode and the output current from P2 reduces to current flowing through resistor divider formed by R1 and R2.

The gradual transition of transistor N1 from saturation to linear mode and final to triode mode by the voltage control loop guarantees a smooth and seamless transition from constant current mode to constant voltage mode of operation. The voltage control loop is formed by the resistor voltage divider network R1/R2 generating the feedback voltage VFB, the differential amplifier A1, having VFB and reference voltage VREF as inputs, transistor N2 and current mirror P1/P2 providing an output current to the resistor voltage divider network R1/R2 and to a load if enabled.

Actually the current sensing can be used in different ways:

If the Current Sense current is a scaled version of the output current, then the load current must be smaller than the current limit of the startup current to allow a voltage ramp-up.

If the Current Sense is based on the slope of the output node voltage using a sense capacitor then any kind of DC load could be accepted until the maximum current limit is reached.

Also possible is a combination of these methods in the current sense or an external control which increases the current limit when the system is in startup for a longer period of time.

Transition from Startup Current Limit to Normal Output Current Limit:

As potential at CL_LDO increases and gets higher than reference voltage VREF1, wherein VREF1 represents the current limit of LDO, the output CTRL of comparator 122 is asserted and latched. The assertion of CTRL is fed as input to current DAC 120 and the output current limit for the LDO is restored to its normal value.

Figure 1:
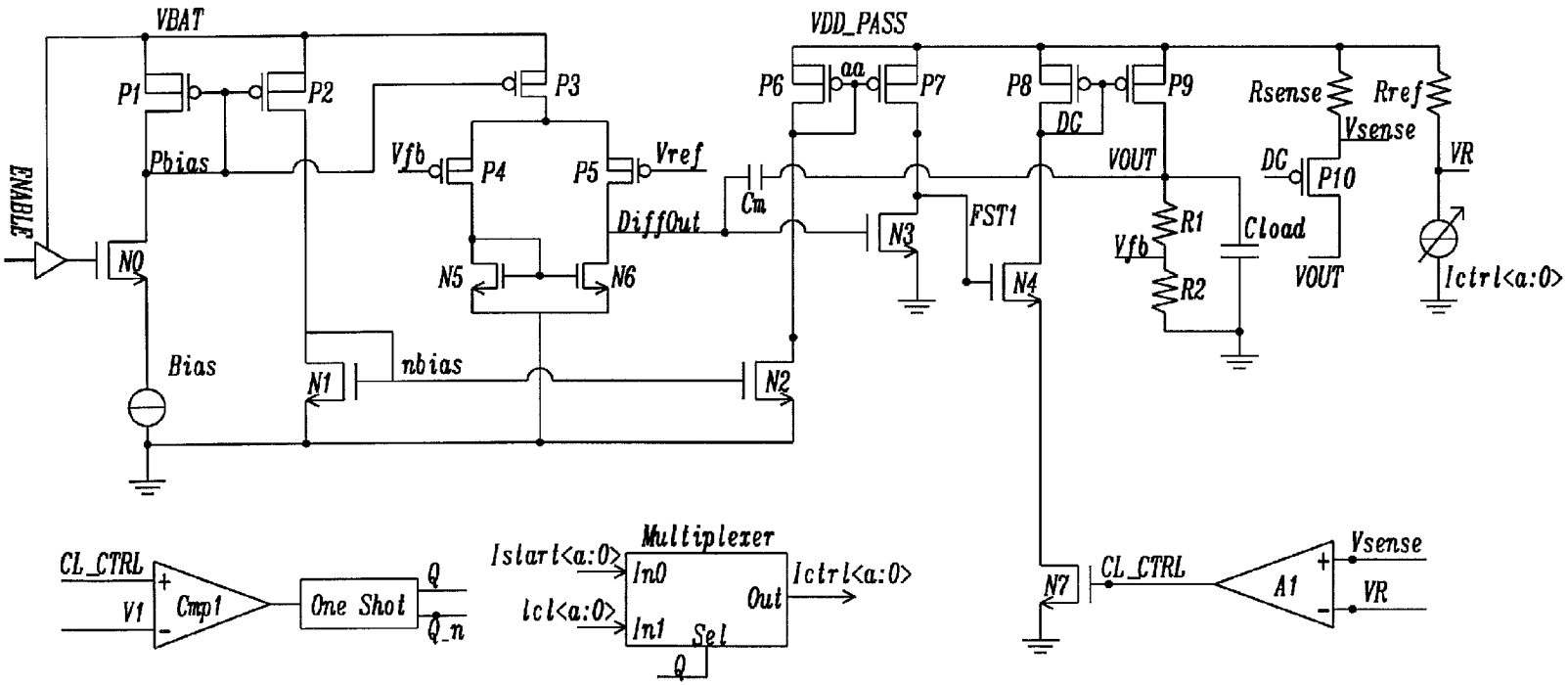
FIG. 1 shows as a non-limiting example of the disclosure an implementation of the (CC-CV) method disclosed for controlling the inrush current during startup for a low drop-out (LDO) regulator and to ensure a clean transition from CC mode to CV mode.

FIG. 1 shows as a non-limiting example of the disclosure in more details than in FIG. 12 an implementation of the (CC-CV) method disclosed for controlling the inrush current during startup for a low drop-out (LDO) regulator and to ensure a clean transition from CC mode to CV mode.

The CC-CV circuit implementation of FIG. 1 comprises a current mirror configuration comprising transistors P8/P9/P10, wherein P9 provides the startup current charging the output capacitor COUT during the startup phase and output current to node VOUT, and wherein current sense device P10 connected to voltage sense resistor Rsense to signify a voltage Vsense, a resistor Rref to provide a reference voltage VR together with a current digital-to-analog converter IDAC receiving a digital input Ictrl<a:0>, an amplifier A1, a voltage comparator Cmp1, a monostable circuit One Shot, and a digital multiplexer 10 having digital inputs and the digital output Ictrl<a:0> controlling the IDAC. The nomenclature <a:0> denotes a digital control bus having (a+1) inputs. The digital input Ictrl<a:0> determines a target value of the constant startup current and this digital symbol is converted into an analog current representation The two digital inputs for the multiplexer are control bits Istart<a:0> defining a target value of the constant startup current and control bits for determining the current limit Icl<a:0>. The value of Icl<a:0> sets the current limit for the output current in normal mode of operation.

When ENABLE=0, i.e. the LDO is disabled, the potential at various nodes are shown in the following table:

| VBAT | VDD_PASS | GROUND |
|---|---|---|
| Pbias | DG, AA, Vsense, VR | Nbias, Diffout, FST1, VOUT, Vfb, CL_CTRL, Q |

The nodes mentioned in the table above are pulled to respective potential using transistors that are not shown in the circuit diagram of FIG. 1 in order to avoid non-relevant details.

Circuit Operation during startup phase is as follows:

- When ENABLE moves from low to high, transistor N0 is switched ON.
- Current Ibias starts to flow via N0 into P1 and node Pbias moves from voltage VBAT to a threshold voltage below VBAT voltage. The current Ibias is mirrored into transistors P2 and P3.
- The current through transistor P2 flows into transistor N1 and node nbias moves from ground to a threshold voltage above ground. The current through transistor N1 is mirrored into transistor N2. The flow of current from transistor N2 biases transistor P6 and node AA is pulled from VDD_PASS to a threshold voltage below VDD_PASS
- The feedback voltage Vfb from the voltage divider R1/R2 at the gate of transistor P4 is close to 0V so current from transistor P3 flows into transistors P4 and N5 which pulls node Diffout close to ground potential (Vref>Vfb results in current through transistor P5 to be far smaller than through transistor P4. The current through transistor P4 equals the current through transistor N5. N5 being diode connected mirrors the same current through N6 but the current from transistor P5 is very small and node Diffout is pulled close to ground).

It should be noted that voltage Vref represents a target output voltage of the LDO and the voltage VR represents via resistor Rref or via a means of resistance the output current of the current digital-to-voltage converter IDAC.

Node Diffout being close to 0V switches OFF transistor N3. The current from transistor P7 raises the potential at FST1 to VDD_PASS and transistor N4 is fully ON.

As node Q is 0V, Ictrl<a:0>=Istart<a:0>. The value of Istart<a:0> sets the current in the current digital-to-analog converter Idac, which fixes the current through resistor Rref and hence the potential VR.

When the IDAC current starts to flow through resistor Rref voltage Vr gets lower than voltage Vsense and the output of amplifier A1 "CL_CTRL" starts to increase above ground potential. The increase of potential at gate of N7 starts the flow of current from P8 to N4 to N7 to ground.

The current from P8 is mirrored into the pass device P9 and into the current sense device P10. The flow of current through P10 causes a voltage drop across resistive means as e.g. resistor Rsense.

The voltage at CL_CTRL keeps increasing till voltage Vsense equals voltage VR. Once Vsense=VR the voltage at output of amplifier A1 is constant. The ratio of transistor size between transistors P10 and P9 determines the current through P9 and the output capacitor Cout is charged with a fixed current. Changing the current generated by digitally controlled current source Idac by adjusting Istart<a:0> changes the current to charge the output capacitor Cout. The constant startup current (CC) Istart part of the method disclosed is implemented and a clean transition follows.

As the output voltage VOUT increases so does voltage at node Vfb. Once Vfb is close to voltage Vref, the potential at node Diffout increases and comes close to its normal operating voltage. As the potential of Diffout increases transistor N3 starts to conduct and node Fst1 is pulled close to normal operating voltage. As the potential at Fst1 decreases, the voltage across transistor N7 decreases (voltage at gate of N4 fixes the voltage at source N4).

Voltage reduction at Fst1 reduces current through transistor P8 which moves potential at node DG close to VDD_PASS. The currents through transistor P9 and P10 decrease. Reduction of the current through P10 causes Vsense to move closer to VDD_PASS and the difference between Vsense and Vref becomes larger. The amplifier A1 increases the voltage at its output so as to decrease voltage difference between nodes Vsense and VR. As CL_CTRL starts to increase the "constant voltage" (CV) loop starts to take the control.

Once CL_CTRL gets higher than voltage V1 the output of comparator Cmp1 gets asserted, resulting in output of monostable "One Shot" Q getting asserted. Once Q is asserted Icl<a:0> is available at the output and the current generated by the digitally controlled current source Idac is set for the current limit of normal mode of operation.

The voltage V1 must be larger than the gate-source voltage Vgs of the current limit transistor N7. For example voltage V1 may be twice as high as voltage Vgs. It is important that Cmp1 can clearly detect a crossing when CL_CTRL ramps toward the upper rail.

Figure 2:
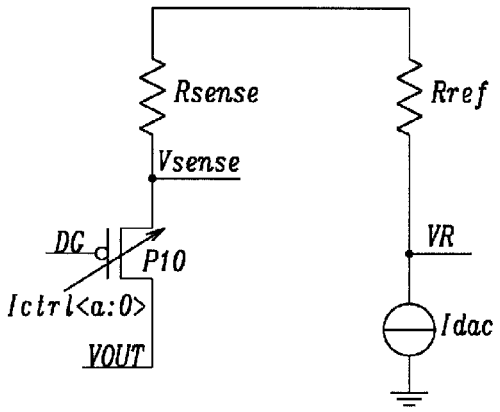
FIG. 2 illustrates the control of the setting of the constant current to be achieved by changing the size of transistor P10.
Figure 3:
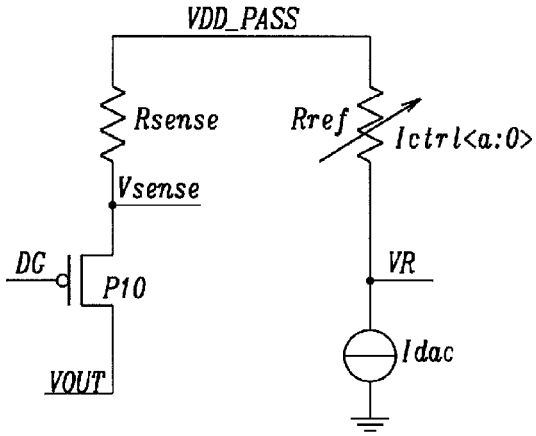
FIG. 3 depicts the control of the setting of the constant current to be achieved by changing the size of the reference resistor Rref used to generate the voltage VR.
Figure 4:
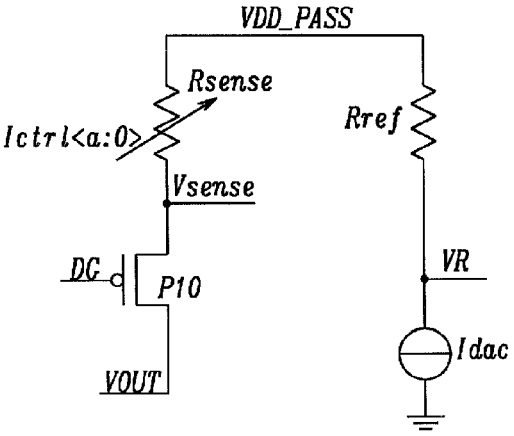
FIG. 4 shows the control of the setting of the constant current to be achieved by changing the size of the sense resistor Rsense used to generate the voltage Vsense.

FIGS. 2-4 show alternatives how the control of setting the varying Istart current limit can be achieved.

FIG. 2 illustrates the control of the setting of the current limit to be achieved by changing the size of transistor devices P10. FIG. 2 shows a fixed voltage across resistor Rref generated by the current digital-to-analog converter Idac. Changing the number of P10 devices changes a ratio of the output current to this scaled current, therefore changing the current limit when both voltages Vsense and VR are equal.

FIG. 3 depicts the control of the setting of the current limit to be achieved by changing the size of the reference resistor Rref used to generate the voltage VR. FIG. 4 shows the control of the setting of the current limit to be achieved by changing the size of the sense resistor Rsense used to generate the voltage Vsense.

It should be noted that it is also possible to use combination of all or any of circuits shown in FIGS. 2-4 to control the current limit.

Figure 5:
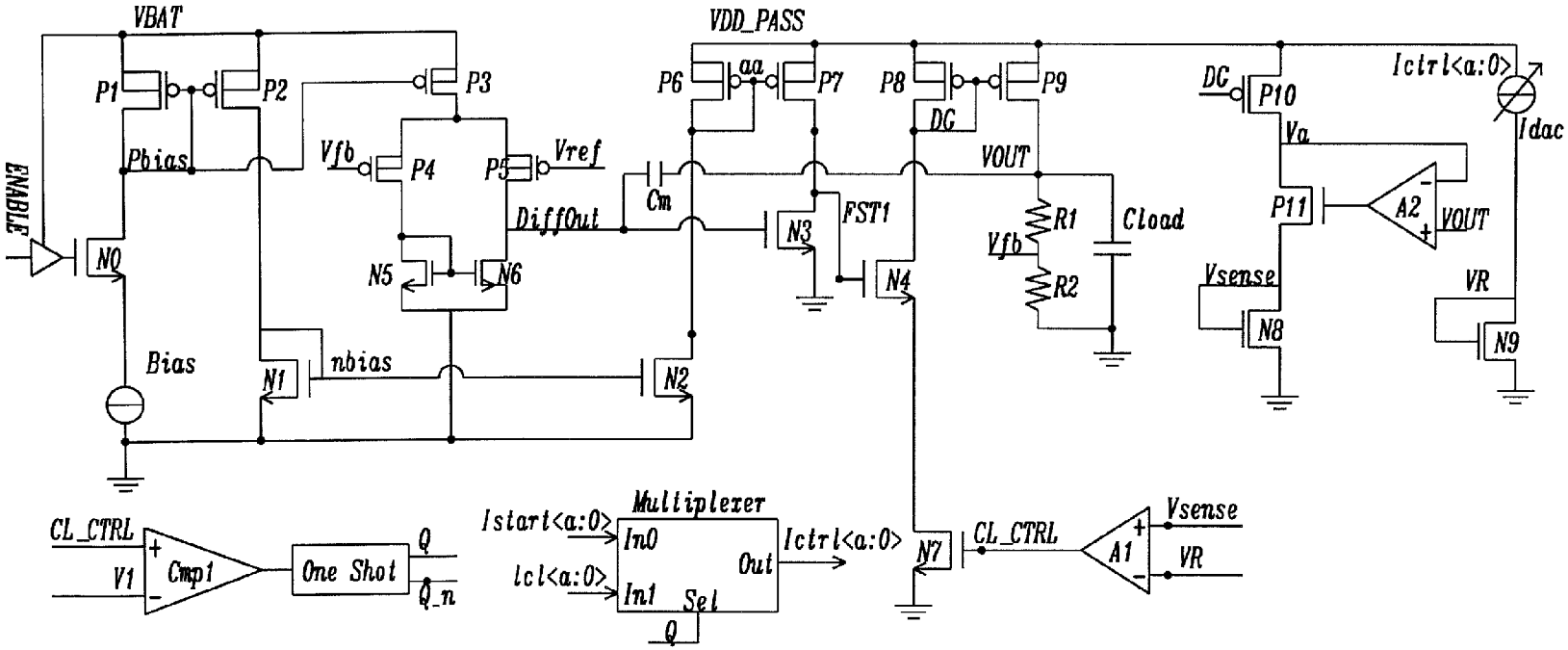
FIG. 5 shows an alternative way, among any other possible ways, of sensing the start-up current.

FIG. 5 shows an alternative way, among any other possible ways, of sensing the start-up current. FIG. 5 shows a varying voltage across resistor Rref generated by the current digital-to-analog converter Mac, therefore changing the current when both voltages Vsense and VR are equal.

In a first step a current from the digitally controlled current source Idac is sourced into any resistive means as e.g. diode connected NMOS transistor N9 to generate reference voltage VR. Modifying the current from the Idac or the size of N9 or both can be used to generate different VR voltages.

In the circuit of FIG. 5 amplifier A2 along with transistor P11 keeps the voltage across transistor P10 on the same level as across P9.

Once the current starts to flow through the Idac, voltage VR is higher than voltage Vsense. The output of amplifier A1 increases which allows the flow of current into transistors P8, P9 and P10. The current in P10 flows into diode connected transistor N8 and the voltage at node Vsense increases. The output of A1 increases till the voltage at Vsense teaches the same level as voltage VR. The ratio of sizes between P9 and P10 decides the level of the current at startup flowing into the output capacitor Cout. Increasing or decreasing voltage VR would increase or decrease the startup current. This circuit allows the implementation of the constant-current (CC) method during startup phase of the LDO As the voltage VOUT at output increases so does voltage at node Vfb. Once Vfb is close to Vref voltage level, the potential at node Diffout increases and comes close to its normal operating voltage. As voltage Diffout increases, transistor N3 starts to conduct and node Fst1 is pulled close to normal operating voltage. As the potential at Fst1 decreases, the voltage across transistor N7 decreases (voltage at gate of N4 fixes the voltage at source N4).

The voltage reduction at Fst1 reduces the current through P8 which moves the potential at node DG close to VDD_PASS. The currents in P9 and P10 decrease. Reduction of the current through P10 causes voltage Vsense to reduce with respect to voltage VR. When the size of P10 is changed the current flowing through Rsense subsequently changes and thus the voltage of node Vsense is changed. The amplifier A1 increases the voltage at its output so as to decrease voltage difference between Vsense and VR. As CL_CTRL starts to increase it is start of "constant voltage" (CV) loop taking the control Once CL_CTRL gets higher than V1 the output of comparator Cmp1 gets asserted, resulting in output of monostable "One Shot" Q getting asserted. Once Q is asserted Icl<a:0> is available at output and the current in the Idac is set for current limit in normal mode of operation.

Figure 6:
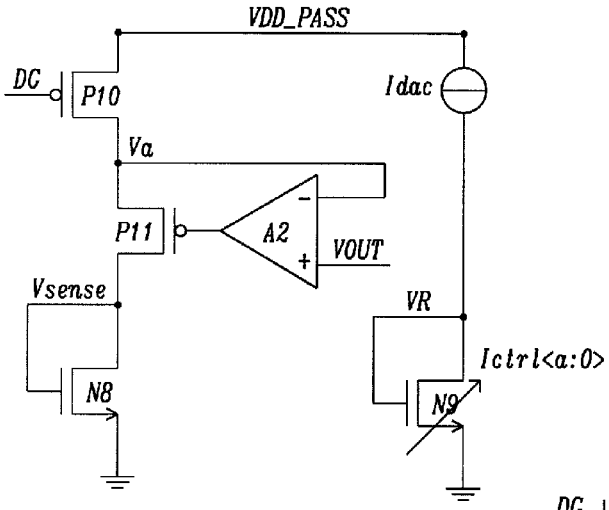
FIG. 6 illustrates how the current during startup phase can be modified by changing the size of transistor N9 according the circuit of FIG. 5.

The current during startup phase can be modified by changing the size of N9 as shown in FIG. 6 according the circuit of FIG. 5.

Figure 7:
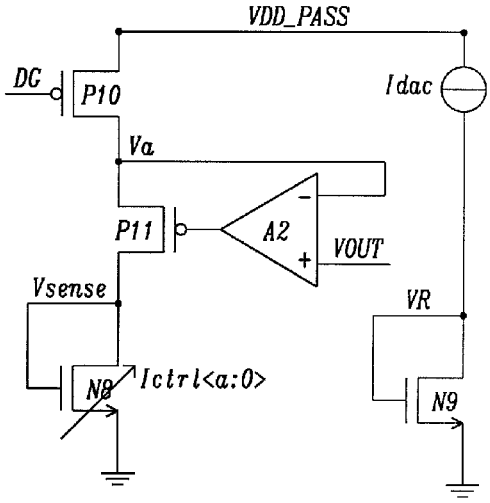
FIG. 7 depicts how the current during startup phase can be alternatively modified by changing the size of transistor N8 according the circuit of FIG. 5.

The current during startup phase can be alternatively modified by changing the size of N9 as shown in FIG. 7 according the circuit of FIG. 5.

Figure 8:
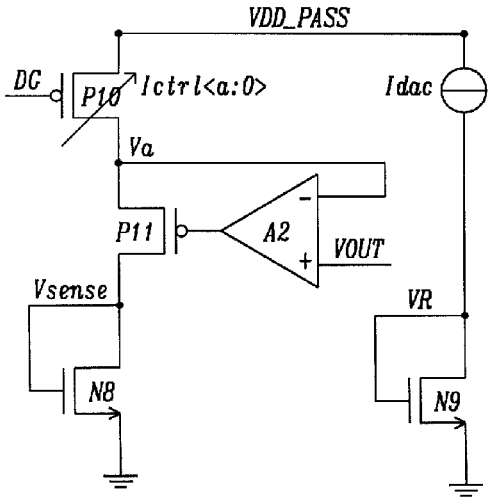
FIG. 8 shows how the current during startup phase can be alternatively modified by changing the size of transistor P10 according the circuit of FIG. 5.

The current at startup can be modified by changing the size of P10 as shown in FIG. 8 according the circuit of FIG. 5.

The current during startup can be modified by using one of the implementations shown in FIGS. 6-8 or using a combination of some of the implementations shown or using a combination of all the implementations shown as required by design of the electronic apparatus.

The voltages VR and Vsense can be generated by using one or more of the following:

PN diode

PMOS as diode

Resistors

NMOS or PMOS as resistors

Bipolar transistors.

Figure 9:
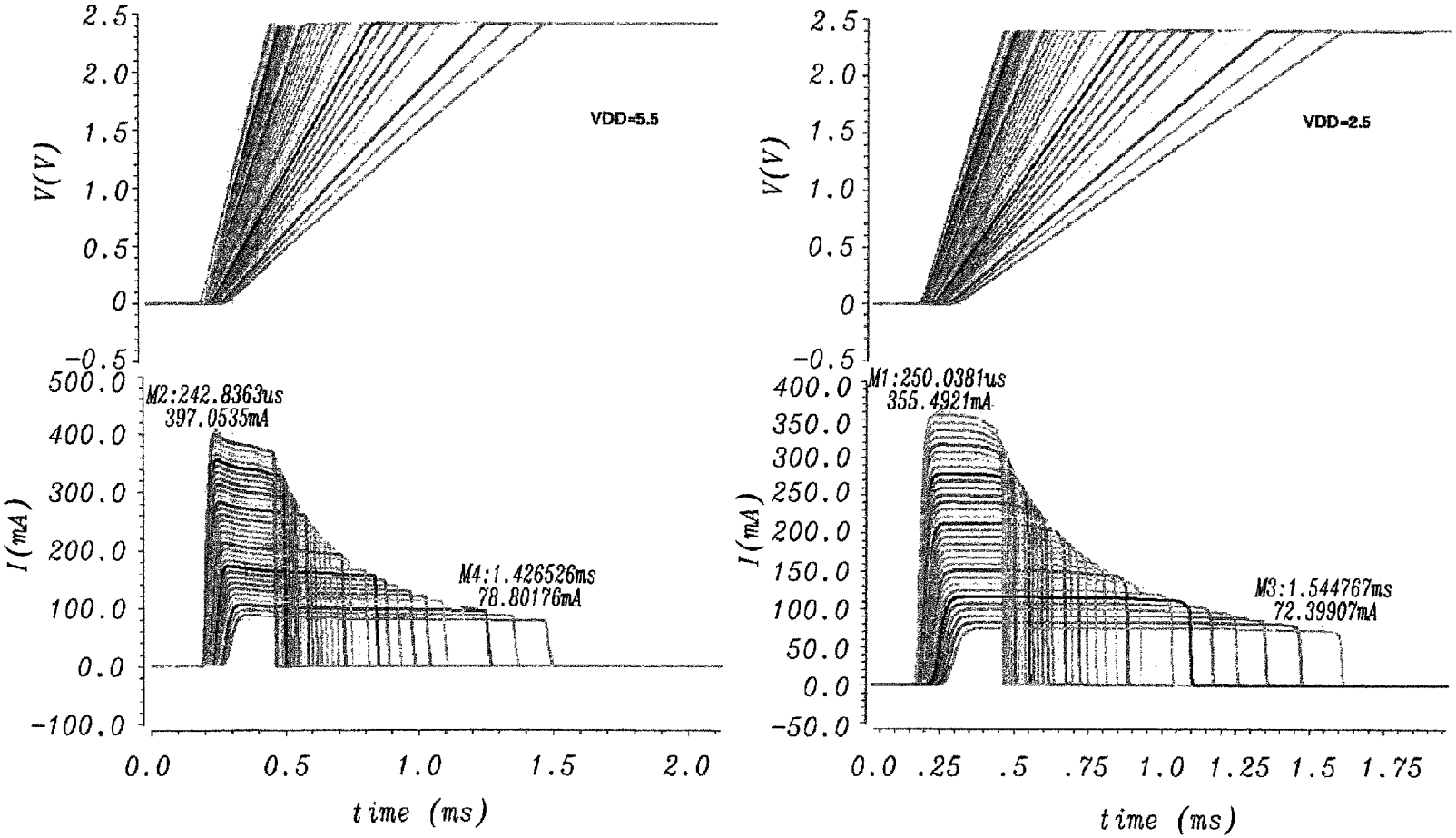
FIG. 9 shows time-diagrams of constant-current and constant-voltage method applied to a LDO during start-up and transition to CV mode.

FIG. 9 shows time-diagrams of constant-current and constant-voltage method applied to a LDO during start-up and transition to CV mode.

The traces on the top of FIG. 9 show fixed slopes for ramping of the output voltage and the slope of ramp changes as a function of the value of the constant-current used to charge the output capacitor.

The bottom traces of FIG. 9 show the current through the pass device. The part of the trace that has zero slope corresponds to constant-current and once the voltage at output reaches close to the target voltage the current in the pass device reduces as the constant voltage loop takes over the control. The plot on the left side of FIG. 9 is based on a supply voltage VDD of 5.5 V and the plot on the right side is based on a supply voltage VDD of 2.5 V.

Figure 10:
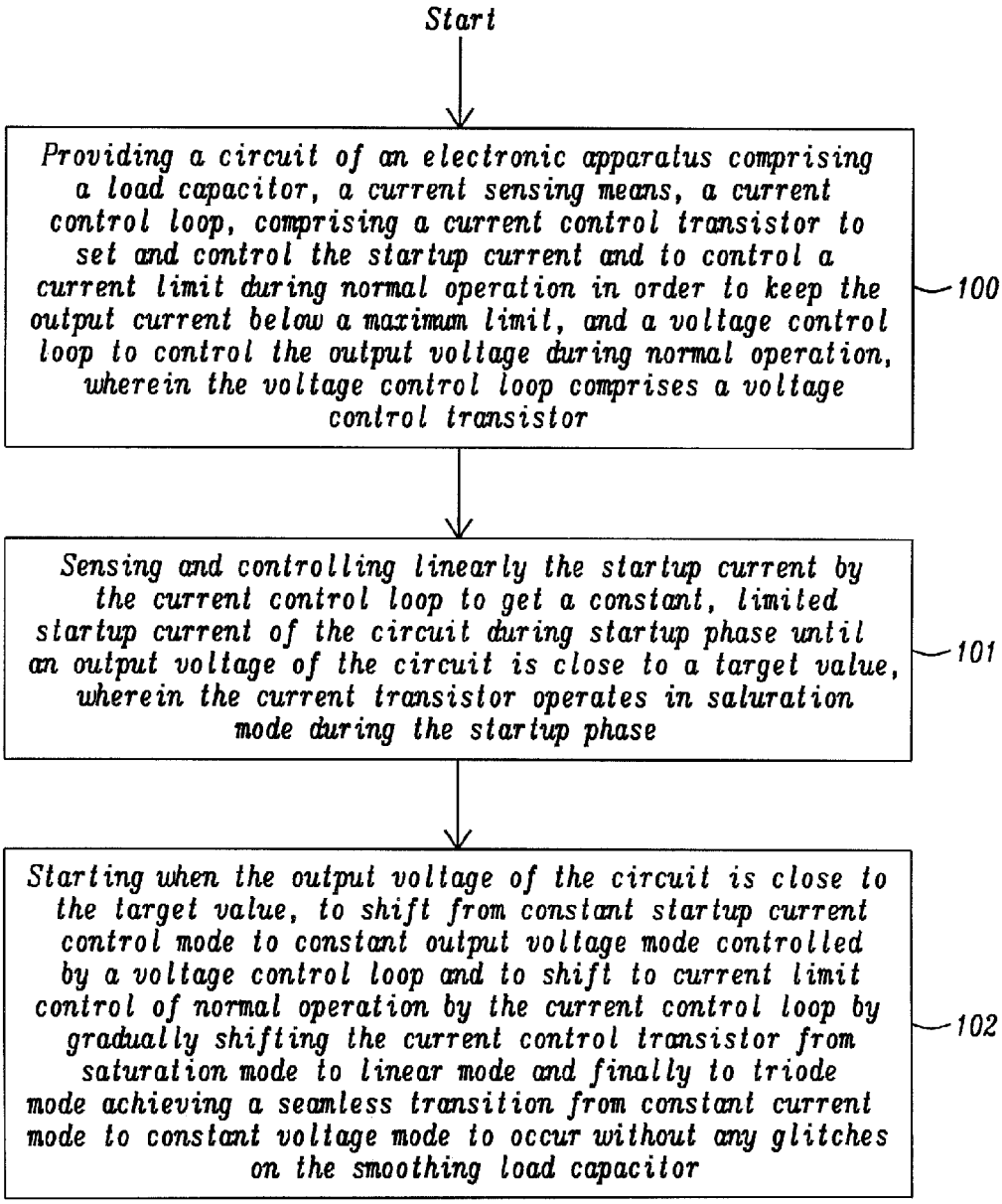
FIG. 10 shows a flowchart of a method for linearly controlling a limited constant current during startup of electronic devices independent of load capacitor size until output voltage of normal operation is reached and a clean transition without glitches from a constant current (CC) mode during startup to a constant voltage (CV) mode during normal operation (CC-CV method).
Figure 11:
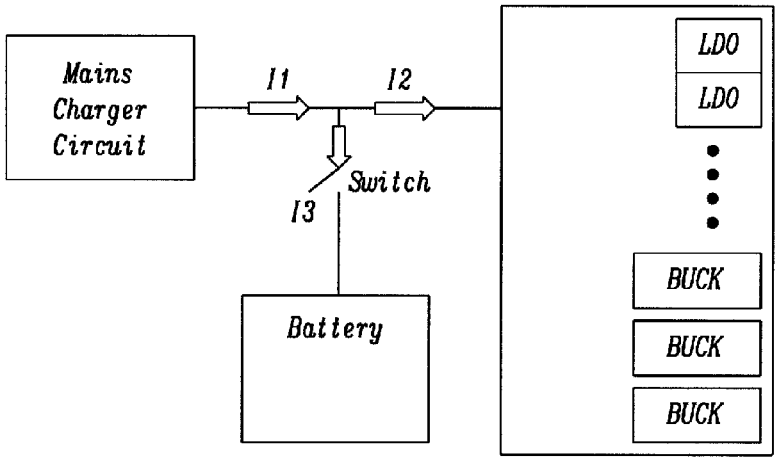
FIG. 11 Prior Art

FIG. 10 shows a flowchart of a method for linearly controlling a limited, constant current during startup of electronic apparatus independent of load capacitor size until an output voltage of normal operation is reached and a clean transition without glitches from a constant current (CC) mode during startup to a constant voltage (CV) mode during normal operation (CC-CV method).

A first step 100 shows providing a circuit of an electronic apparatus comprising a load capacitor, a current sensing means, a current control loop, comprising a current control transistor to set and control the start-up current and to control a current limit during normal operation in order to keep the output current below a maximum limit, and a voltage control loop to control the output voltage during normal operation, wherein the voltage control loop comprises a voltage control transistor. The following step 101 illustrates sensing and controlling linearly the startup current by the current control loop to get a constant, limited start-up current of the circuit during start-up phase until an output voltage of the circuit is close to a target value, wherein the current control transistor wherein the current control transistor operates in saturation mode during the startup phase. Finally step 102 describes starting, when the output voltage of the circuit is close to the target value, to shift from constant startup current control mode to constant output voltage mode controlled by a voltage control loop and to shift to current limit control of normal operation by the current control loop by gradually shifting the current control transistor from saturation mode to linear mode and finally to triode mode achieving a seamless transition from constant current mode to constant voltage mode to occur without any glitches on the smoothing load capacitor.

While the invention has been particularly shown and described with reference to the preferred embodiments thereof, it will be understood by those skilled in the art that various changes in form and details may be made without departing from the spirit and scope of the invention.

What is claimed is:

1. A method for linearly controlling a limited, constant current during startup of a circuit of an electronic apparatus until an output voltage is close a target voltage of normal operation is reached independent of load capacitor size and a clean transition without glitches from a constant current (CC) mode during startup to a constant voltage (CV) mode during normal operation (CC-CV method), the method comprising the steps of:

(1) providing a circuit of an electronic apparatus comprising a load capacitor, a current sensing means, a current control loop, comprising a current control transistor to set and control the start-up current and to control a current limit during normal operation in order to keep the output current below a maximum limit, and a voltage control loop to control the output voltage during normal operation, wherein the voltage control loop comprises a voltage control transistor;

(2) sensing and controlling linearly the startup current by the current control loop to get a constant, limited start-up current of the circuit during start-up phase until an output voltage of the circuit is close to a target value, wherein the current control transistor wherein the current control transistor operates in saturation mode during the startup phase; and (3) starting, when the output voltage of the circuit is close to the target value, to shift from constant startup current control mode to constant output voltage mode controlled by a voltage control loop and to shift to current limit control of normal operation by the current control loop by gradually shifting the current control transistor from saturation mode to linear mode and finally to triode mode achieving a seamless transition from constant current mode to constant voltage mode to occur without any glitches on the smoothing load capacitor.

2. The method of claim 1, wherein the electronic apparatus is a low drop-out regulator.

3. The method of claim 1, wherein the electronic apparatus is a voltage amplifier.

4. The method of claim 1, wherein the electronic apparatus is a DC-to-DC regulator.

5. The method of claim 1, wherein the current control loop is configured to determine during the start-up phase a difference between an actual value of the startup current sensed by a current sense circuitry and a target value of the constant startup current, wherein the difference is amplified by a differential amplifier, wherein an increase of the output of the differential amplifier increases a potential at a gate of a current control transistor which is during the startup phase causing an increase of the current through a pass resistor of the circuit until the difference between the actual value of the startup current and the target value of the startup current gets to zero and then the load capacitor is charged with a constant current.

6. The method of claim 5, wherein the current control loop also controls that a maximum allowable limit of the output current of the circuit is not exceeded during normal operation.

7. The method of claim 5, wherein a current digital-to analog converter is configured to provide the target value of the constant startup current and a current limit of an output current during normal operation.

8. The method of claim 1, wherein the voltage control loop is configured to sense a feedback voltage, which is representative of the output voltage of the circuit, and to drive a pass transistor of the circuit depending on a voltage difference between the value of the feedback voltage and a reference voltage representing a target output voltage via a gate of a voltage control transistor which is in series connected to the current control transistor.

9. The method of claim 8, wherein an operating point of the gate of the voltage control transistor in the voltage control mode is close to the threshold voltage of the voltage control transistor.

10. The method of claim 8, wherein during startup phase the voltage difference between the value of the feedback voltage and the reference voltage, which is connected to the gate of the voltage control transistor is getting smaller thus reducing a voltage across the current control transistor thus starting a gradual transition of the current control transistor from saturation to linear region of operation.

11. The method of claim 1, wherein the gradual transition of the current control transistor from saturation to linear mode causes the current through the current control transistor to decrease and hence the current through the pass transistor charging the output capacitor decreases and hence the difference between the actual value of the startup current and a target value of the constant startup current increases causing an increase of the output of the amplifier connected to the gate of a current control transistor, wherein during the startup phase the output voltage of the circuit increases thus the difference between the feedback voltage and the reference voltage is getting smaller until it gets to zero and the voltage decrease at the gate of the voltage control transistor pushes the current control transistor deep into triode operation mode and hence the output current reduces to current flowing through a resistive voltage divider.

12. The method of claim 11, wherein the increase of the output of the amplifier connected to the gate of a current control transistor is enabled to extend till it is saturated and is clamped to supply voltage.

13. The method of claim 1, wherein the startup phase of the circuit ends when the output voltage of the circuit reaches 90% of the target output voltage and then the transition to a constant voltage mode is started.

14. A circuit capable of linearly controlling a limited, constant startup current during a startup phase of an electronic apparatus having a load capacitor, until an output voltage close to a target value of the output voltage of normal operation is reached, wherein a clean transition from a constant current (CC) mode during the startup phase to a constant voltage (CV) mode during normal operation independent of a size of the load capacitor without glitches is ensured, comprising:

a pass transistor, capable of providing a constant output current to during the startup phase and an output current during normal operation, wherein the pass transistor is connected between a supply voltage, an output port, and an arrangement in parallel of an output capacitor and a resistive voltage divider, which is deployed between the output port and ground, wherein a middle point of the voltage divider is capable of providing a feedback voltage representing the output voltage:

a current control loop comprising a current control transistor capable of controlling a constant, limited start-up current of the circuit during a start-up phase until an output voltage of the circuit has reached a value close to a target value and to keep the output current below a limit after the startup phase during normal operation of the circuit; and a voltage control loop capable of controlling the output voltage of the circuit, wherein the control loop is configured to gradually starting to control the output voltage when the output voltage has reached a value close to the target value and is in full control when the output voltage is reached, wherein the voltage control loop is capable of gradually shifting the current control transistor from saturation mode to linear mode and finally to triode mode during the transition from constant current mode to constant voltage mode in order to achieve a seamless transition without glitches.

15. The circuit of claim 14, wherein the electronic apparatus is a low drop-out regulator.

16. The circuit of claim 14, wherein the electronic apparatus is a voltage amplifier.

17. The circuit of claim 14, wherein the electronic apparatus is a DC-to-DC regulator.

18. The circuit of claim 14, wherein the pass transistor is controlled via a transistor, which is connected to the pass transistor in a current mirror configuration.

19. The circuit of claim 14, wherein the current control loop is configured during the startup phase to determine a difference between an actual value of the startup current sensed by a current sense circuitry and a target value of the constant startup current, wherein the difference is amplified by a differential amplifier, wherein an increase of the output of the differential amplifier increases a potential at a gate of the current control transistor which is causing, during startup phase an increase of the current through a pass resistor of the circuit until the difference between the actual value of the startup current and the target value of the startup current gets to zero and then the load capacitor is charged with a constant current.

20. The circuit of claim 18, wherein the current control loop also controls that a maximum allowable lime of the output current is not exceeded during normal operation.

21. The circuit of claim 14, wherein a current digital-to analog converter is configured to provide the target value of the constant startup current and a current limit of an output current during normal operation to a first differential amplifier which is configured to amplify a difference between the target value of the constant startup current or the current limit of an output current and an output of a current sensing circuitry sensing the output current.

22. The circuit of claim 21, wherein the circuit is configured to generate a reference voltage representing the target value of the output current of the circuit convert using an output current of the current digital-to analog converter via a reference resistor deployed between the supply voltage and an output node of the current digital-to analog converter.

23. The circuit of claim 21, wherein the target value of the output current during normal operation is set by an input to a comparator, wherein the comparator is configured to compare the input value of the target value with the output of the first differential amplifier amplifying the difference between the output current sensed and the target value of the output current.

24. The circuit of claim 23, wherein the output of the comparator is asserted and latched when a potential of the output of the first differential amplifier is higher than the second input of the comparator determining the output current limit, wherein the assertion of the output of the latch is fed as input to the current digital-to-analog converter and the output current limit of the circuit during normal operation is thus restored.

25. The circuit of claim 21, wherein the circuit is configured to generate a reference voltage representing a target value of the output current of the circuit convert using an output current of the current digital-to analog converter via a resistive means wherein a first terminal of the current digital-to analog converter is connected to supply voltage, and the resistive means is connected between a second terminal of the current digital-to analog converter and ground.

26. The circuit of claim 25, wherein the resistive means is a diode connected NMOS transistor.

27. The circuit of claim 26, wherein modifying the current from the current digital-to analog converter or the size of the diode connected NMOS transistor can be used to modify said different reference voltage representing a target value of the output current.

28. The circuit of claim 23, wherein the first differential amplifier, the comparator and a latch connected to an input of a current digital-to analog converter determine the transition from the constant current mode during startup phase to a regulated constant voltage mode during normal operation.

29. The circuit of claim 14, wherein the voltage control loop is configured to sense a feedback voltage, which is representative of the output voltage of the circuit, and to drive the pass transistor of the circuit depending on a voltage difference between the value of the feedback voltage and a reference voltage representing a target output voltage via a gate of a voltage control transistor which is in series connected to the current control transistor.

30. The circuit of claim 29, wherein the voltage control transistor is configured to reduce a voltage across the current control transistor during startup phase when the voltage difference between the value of the feedback voltage and the reference voltage is getting smaller thus is starting a gradual transition of the current control transistor from saturation to linear region of operation.

31. The circuit of claim 29, wherein a second differential amplifier has inputs and an output wherein a first input is a feedback voltage from a voltage divider representing the output voltage, a second input is a reference voltage representing the output voltage during normal operation, and the output of the second differential amplifier is connected to a gate of the voltage control transistor.

32. The circuit of claim 19, wherein the current sense circuitry comprises a resistive means having a first terminal connected to supply voltage and a transistor connected between the resistor and the output port, wherein a gate of the transistor is connected to a gate of the pass transistor and wherein a voltage at the node Vsense between the transistor and the resistive means is used as reference voltage representing the actual output current.

33. The circuit of claim 32, wherein the resistive means is a resistor.

34. The circuit of claim 32, wherein modifying the current from the current digital-to analog converter or the resistance of the resistive means can be used to modify said different reference voltage representing a target value of the output current.

* * * * *